US005402606A

United States Patent [19]

Helgren

[11] Patent Number: 5,402,606

[45] Date of Patent: Apr. 4, 1995

[54] ROLL GRINDER

[75] Inventor: Dale E. Helgren, Green Bay, Wis.

[73] Assignee: Voith Sulzer Paper Technology North America, Inc., Appleton, Wis.

[21] Appl. No.: 206,863

[22] Filed: Mar. 4, 1994

[51] Int. Cl.[6] ..... B24B 1/00

[52] U.S. Cl. ..... 451/184; 51/289 R; 409/199; 29/28; 82/129; 82/148; 451/189; 451/285; 451/397

[58] Field of Search ..... 51/72 R, 726, 76 R, 51/78, 79, 103 R, 104, 236, 289 R, 33 W, 42, 48 K; 409/199; 29/563, 28, 33 P; 82/129, 148, 142

[56] References Cited

U.S. PATENT DOCUMENTS 4,423,990 1/1984 Kodama et al. ..... 51/289 R
5,035,086 7/1991 Katsuki et al. ..... 51/289 R

*Primary Examiner*—Bruce M. Kisliuk
*Assistant Examiner*—Eileen P. Morgan
*Attorney, Agent, or Firm*—Baker & Daniels

[57] ABSTRACT

A dual roll grinder employs a first and second work station including a dual drive headstock disposed therebetween. A grinding assembly and the dual drive headstock translatably move along a bed to engage rolls in either of the two stations. This permits unloading and loading of a new roll in the station not currently active.

11 Claims, 3 Drawing Sheets

ROLL GRINDER

BACKGROUND OF THE INVENTION

The present invention relates generally to roll grinders used for milling steel rolls.

A typical roll grinder is a specialized type of machine tool similar to a large lathe that normally includes a front bed assembly which holds and turns a workpiece (roll) and a back bed assembly which contains a powered grinding wheel under CNC computer control.

During the grinding process, a roll is loaded into the roll supports on the front bed via a crane or similar means. A roll drive and tailstock are engaged after which the roll drive begins to rotate the workpiece for grinding. The grinding wheel engages the workpiece for grinding via movement along transverse and infeed axes and proceeds to grind the roll body in a series of back and forth cutting passes. With each pass, the grinding wheel is kept engaged to the roll, following a complex mathematical profile generated by the servo infeed axes of the grinding wheel assembly controlled by the computer.

This grinding process continues for several minutes to several hours depending upon the application and type of roll profile desired. A typical steel mill work roll takes approximately 30 minutes to complete. After the machine completes the grinding process, the grinding wheel retracts from the workpiece and parks while an operator unloads the finished roll and loads a new roll to be ground into the machine. Once the unload/load operation is complete, the grinding process begins again.

The present invention is directed to increasing productivity and decreasing the cycle time associated with roll grinding.

SUMMARY OF THE INVENTION

The present invention increases the throughput of the old style roll grinders by providing a two-station roll grinder mechanism.

Generally, the invention provides a two-station roll grinder in which two rolls may be employed simultaneously to be driven by a single roll drive headstock. The back bed grinding wheel assembly operates without waiting for an unload and load cycle for a finished roll. Once a roll is finished, the grinding wheel can immediately translate to the second station and roll, via the back bed, and in a matter of seconds, begins grinding the second roll. While the roll grinder is engaged in grinding the second roll, the operator removes the first roll and loads an unground roll in its place. Once the second roll is completed, the grinding assembly returns to the first station location and immediately engages in the process of roll grinding. The process continues with the operator alternately loading and unloading rolls on the station opposite of the grinding wheel assembly.

An advantage of the roll grinder of the present invention is that it increases productivity by reducing the amount of time the grinding wheel is out of production due to the unload/load cycle currently employed. The back bed grinding wheel assembly can work continuously without waiting for the unload/load cycle to complete.

Another advantage of the roll grinder of the present invention is that the roll headstock may drive either roll from opposite ends of a single roll drive unit. This reduces the total cost of the unit.

Yet another advantage of the roll grinder of the present invention is that by providing two rolls simultaneously a savings of the unload/load time may be obtained which can range from 20% to 40% of the total machine cycle time.

The invention, in one form thereof, provides a roll grinder comprising a bed having two grinding stations attached thereto to rotatably support two rolls. Each of the grinding stations include a tailstock attached to the bed for supporting undriven ends of the rolls. A roll drive headstock including two driving connections for driving the two rolls is attached to the bed and disposed between the grinding stations. A grinding wheel assembly including a rotatable grinding wheel is translatably attached to the bed to move from one grinding station to the other so that the grinding wheel assembly grinds one roll while another roll is loaded and subsequently translates to and grinds the other roll while a new roll is loaded to replace the first ground roll.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
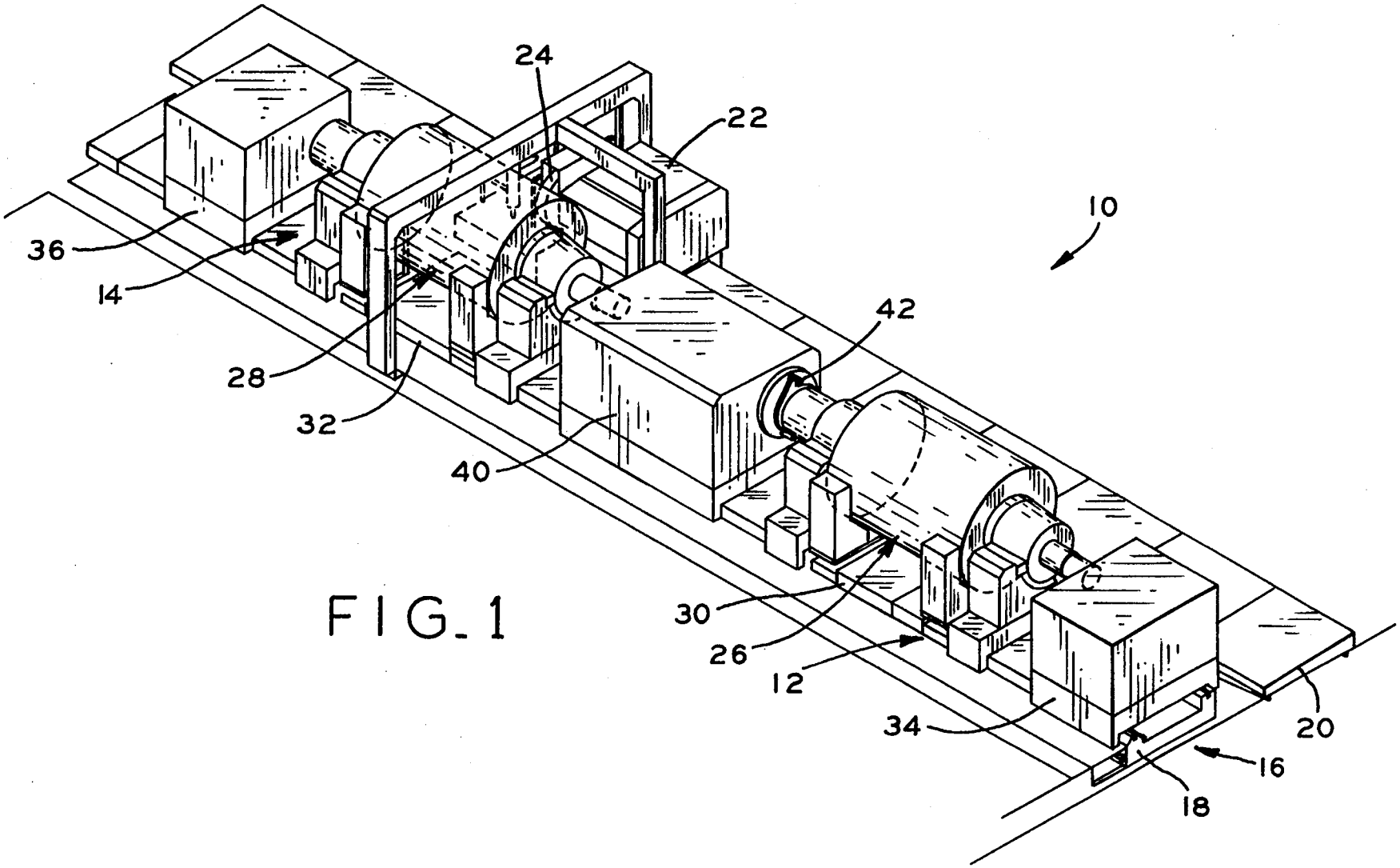
FIG. 1 is a perspective view of the present invention.

In an exemplary embodiment of the invention as shown in the drawings, and in particular by referring to FIG. 1, a two station roll grinder 10 is shown having a first station 12 and a second station 14 translatably attached to a machine bed 16. Machine bed 16 includes a front bed assembly 18 useful in holding and turning the workpieces or rolls 26 and 28 and a back bed assembly 20 on which translatably slides or moves a powered grinding wheel assembly 22. A grinding wheel 24 is drivingly attached to grinding wheel assembly 22 to alternately grind a first roll 26 and a second roll 28 by movement of grinding wheel assembly 22 along back bed assembly 20.

Figure 2:
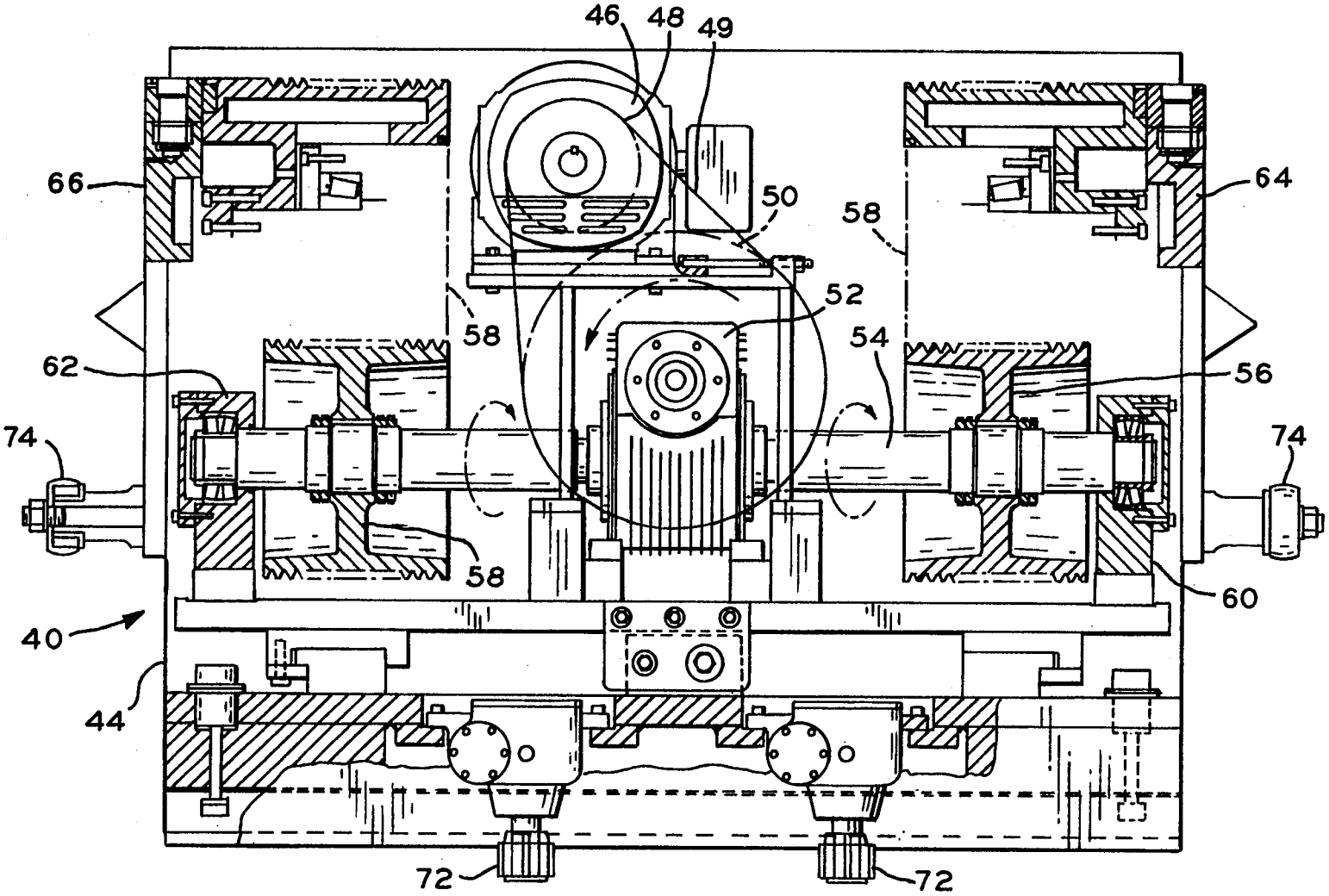
FIG. 2 is a sectional view of the dual roll drive unit of the present invention.

As shown in FIG. 1, first roll 26 is rotatably disposed within the roll support 30 of first station 12 while second roll 28 is rotatably disposed within roll support 32 of second station 14. Tailstocks 34 and 36 are translatably attached to front bed assembly 18, one tailstock associated with each station 12 and 14 respectively. A dual roll drive headstock 40 is translatably and movably disposed on front bed assembly 18 for alternately engaging either roll 26 within first station 12 or roll 28 within second station 14. Drive headstock 40 includes two driving connections 42 disposed on opposite sides of roll drive headstock 40 (See FIG. 2).

Roll drive headstock 40 is enclosed in a housing 44. Disposed within housing 44 is a conventional electric motor 46 connected by pulleys 48 and 50 with a belt 49 therebetween to a conventional gear reduction unit 52 engaging shaft 54 (See FIG. 2). Motor 46, through pulley 48, belt 49 and pulley 50, along with gear reduction unit 52, cause shaft 54 to rotate with a low speed/-high torque characteristic. Two secondary output pulleys 56 and 58 are attached to shaft 54 on opposite sides of gear reduction unit 52. The axially outward ends of shaft 54 are disposed within bearing assemblies 60 and 62 for support.

Figure 3:
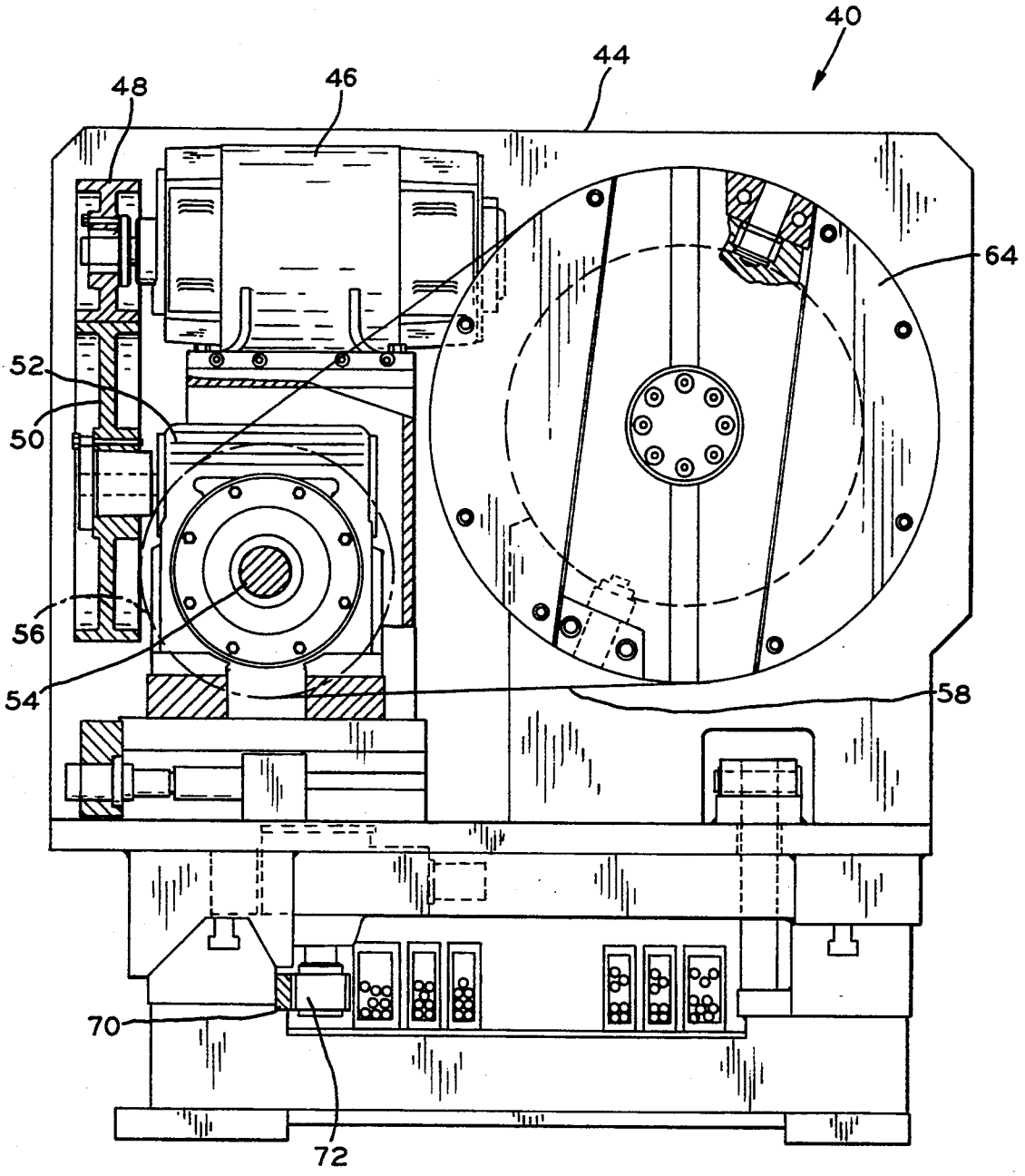
FIG. 3 is a side sectional view of the dual roll drive unit of the present invention.

Primary drive pulleys 64 and 66 are disposed through opposite sides of housing 44 and connected by drive belts 68 to secondary output pulleys 56 and 58 respectively. The connection between a primary drive pulley 64 and secondary output pulley 56 is shown in FIG. 3. Torque from motor 46 is continuously transferred through shaft 54 to pulleys 64 and 66 during motor operation.

During operation, the roll drive headstock 40 selectively engages either roll 26 in first station 12 or second roll 28 in second station 14 by engaging drive pulley 64 or 66 to the selected roll 26 or 28. To do this, headstock 40 translates along the front bed assembly 18 via a hydraulic drive rack 70 and pinion 72 arrangement, to engage a roll either in first station 12 or second station 14, all of which is done under automatic control of a programmable computer, such as a conventional programmable personal computer or microprocessor. Alternatively, other hydraulic or mechanical control methods may be utilized.

Keys 74, disposed on primary drive pulleys 64 and 66, along with drive pulley 64 and 66 create the driving connection between the headstock 40 and rolls 26 and 28. Alternatively, other attachment methods, such as chucks or clamp members, may be used to drivingly attach the drive pulleys 64 and 66 to a selected roll.

Grinding wheel assembly 22, translatably attached to back bed assembly 20, is of conventional design that is computer controlled to follow a selected mathematical profile along the surface of either roll 26 or 28.

In operation, by employing two stations 12 and 14 the grinding operation never need halt for more than the time necessary for grinding wheel assembly 22 and headstock 40 to translate between the two stations 12 and 14. Once a roll, for example 26, is finished, the grinding wheel assembly 22 may move immediately to roll 28 via translation upon back bed assembly 20 and begin rolling grinding roll 28. At the same time grinding wheel assembly 22 translates, roll drive headstock also translates via rack 70 and pinion 72 so that the driving connection or pulley 66 and key 74 engage roll 28 and impart rotational movement from motor 46 to the roll. While the machine is engaged in grinding roll 28, an operator removes the first roll 26 and loads another roll to be ground in its place in first station 12. Once roll 28, in second station 14, is completed, the grinding wheel 22, along with dual drive headstock 40, translatably locates, preferably utilizing computer control, to first station 12 and may immediately engage in the process of grinding the new roll. The process continues with the operator alternatively unloading and loading rolls on station 12 or 14 opposite of the grinding wheel assembly 22. Utilization of the present invention saves almost all of the unload/load time which can range from 20% to 40% of the cycle time regarding prior roll grinders resulting in a direct productivity improvement and complete grinding wheel utilization.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A roll grinder comprising:

a bed;

two grinding stations attached to said bed to rotatably support two rolls, each said grinding station including a tailstock attached to said bed for supporting undriven ends of the two respective rolls;

a roll drive headstock attached to said bed and disposed between said grinding stations, said headstock including two driving connections for driving the two rolls; and a grinding wheel assembly including a rotatable grinding wheel, said grinding wheel assembly translatably attached to said bed to move from one grinding station to the other grinding station, whereby said grinding wheel assembly grinds one roll while another roll is loaded and subsequently translates to and grinds the other roll while a new roll is loaded to replace the ground roll.

2. The roll grinder of claim 1 in which said roll drive headstock includes a single motor driving drivingly connected to said driving connections.

3. The roll grinder of claim 1 in which said roll drive headstock is translatable along said bed via a rack and pinion drive.

4. The roll grinder of claim 1 in which said driving connections are on opposite sides of said roll drive headstock.

5. A roll grinder comprising:

a bed;

two grinding stations attached to said bed to rotatably support two rolls;

a roll drive headstock attached to said bed disposed between said grinding stations, said headstock including two driving connections on opposite sides of said headstock for driving the two rolls; and a grinding wheel assembly including a rotatable grinding wheel, said grinding wheel assembly translatably attached to said bed to move from one grinding station to the other, whereby said grinding wheel assembly selectively grinds one roll at one grinding station permitting a different roll to be loaded into the other grinding station.

6. The roll grinder of claim 5 in which said roll drive headstock includes a single motor driving drivingly connected to said driving connections.

7. The roll grinder of claim 5 in which said roll drive headstock is translatable along said bed via a rack and pinion drive.

8. A roll grinder comprising:

a bed;

two grinding stations attached to said bed to rotatably support two rolls;

a roll drive headstock translatably attached to said bed and disposed between said grinding stations to move from one grinding station to the other, said headstock including two driving connections for selectively driving one of the two rolls by translatably moving to the grinding station supporting the roll to be ground; and a grinding wheel assembly including a rotatable grinding wheel, said grinding wheel assembly translatably connected to said bed to move from one grinding station to the other grinding station, whereby said grinding wheel assembly grinds one roll while another roll is loaded and subsequently translates, with said roll drive headstock, to and grinds the other roll while a new roll is loaded to replace the ground roll.

9. The roll grinder of claim 8 in which said roll drive headstock includes a single motor driving drivingly connected to said driving connections.

10. The roll grinder of claim 8 in which said roll drive headstock is translatable along said bed via a rack and pinion drive.

11. The roll grinder of claim 8 in which said driving connections are on opposite sides of said roll drive headstock.

* * * * *